US007430826B2

(12) United States Patent
Riebling

(10) Patent No.: US 7,430,826 B2
(45) Date of Patent: Oct. 7, 2008

(54) REVOLVER CYLINDER BLOCK

(75) Inventor: J. Terry Riebling, Monroeville, PA (US)

(73) Assignee: Child Guard LLC, Lancaster, PA (US)

( * ) Notice: Subject to any disclaimer, the term of this patent is extended or adjusted under 35 U.S.C. 154(b) by 161 days.

(21) Appl. No.: 10/779,022

(22) Filed: Feb. 13, 2004

(65) Prior Publication Data

US 2004/0159034 A1 Aug. 19, 2004

Related U.S. Application Data

(60) Provisional application No. 60/447,622, filed on Feb. 13, 2003.

(51) Int. Cl.
*F41A 17/00* (2006.01)

(52) U.S. Cl. ..... 42/66; 42/67; 42/70.07; 42/70.11

(58) Field of Classification Search ..... 42/66, 42/70.07, 1.05, 67, 70.01, 70.11
See application file for complete search history.

(56) References Cited

U.S. PATENT DOCUMENTS

| | | | | | |
|---|---|---|---|---|---|
| 945,520 | A | * | 1/1910 | Greenwood | 248/175 |
| 3,307,755 | A | * | 3/1967 | Lentz | 206/317 |
| 3,368,297 | A | * | 2/1968 | Lentz | 42/70.07 |
| 4,023,294 | A | | 5/1977 | Knopp | |
| 4,048,741 | A | | 9/1977 | Chiodo et al. | |
| 4,092,794 | A | | 6/1978 | Moren | |
| 4,412,397 | A | * | 11/1983 | Bayn | 42/70.11 |
| 4,461,108 | A | | 7/1984 | Von Muller | |
| 4,802,298 | A | | 2/1989 | Baugus | |
| 4,827,649 | A | | 5/1989 | Sheehan | |
| 4,934,083 | A | * | 6/1990 | Smith | 42/70.07 |
| 4,965,952 | A | | 10/1990 | Miller et al. | |
| 5,052,142 | A | | 10/1991 | Mikus | |
| 5,097,613 | A | | 3/1992 | Miller et al. | |
| 5,179,234 | A | | 1/1993 | Cvetanovich | |
| 5,412,959 | A | * | 5/1995 | Bentley | 70/30 |
| 5,579,923 | A | * | 12/1996 | Hemmerlein | 211/4 |
| 5,737,864 | A | | 4/1998 | Otto | |
| 5,918,403 | A | | 7/1999 | Lurz, Jr. et al. | |
| 6,382,002 | B1 | | 5/2002 | Chen | |
| 6,457,272 | B1 | | 10/2002 | Weinraub | |
| 6,474,011 | B1 | | 11/2002 | Sato | |
| 6,499,244 | B1 | | 12/2002 | Smith et al. | |
| 6,568,117 | B2 | | 5/2003 | Weinraub | |
| 6,755,054 | B2 | * | 6/2004 | Burmesch et al. | 70/49 |
| 6,880,282 | B1 | * | 4/2005 | Olsen | 42/70.11 |

* cited by examiner

*Primary Examiner*—Michelle Clement
(74) *Attorney, Agent, or Firm*—Howson & Howson LLP

(57) ABSTRACT

A safety device for a revolver including an assembly adapted to be affixed to the revolver on opposite sides of the trigger guard, and a cylinder block connected to the assembly having a rigid leg for extending into a chamber to secure the revolver. The cylinder block includes a base having an aperture and a bent portion disposed between the aperture and the base. One or more pins extend from at least one of the side members for extending through the aperture for attaching the cylinder block to the assembly.

8 Claims, 6 Drawing Sheets

REVOLVER CYLINDER BLOCK

CROSS-REFERENCE TO RELATED APPLICATIONS

This application claims the benefit of U.S. Provisional Application No. 60/447,622 filed Feb. 13, 2003.

BACKGROUND OF THE INVENTION

The present invention relates to a firearm safety device, and more particularly it relates to a cylinder block for securing a firearm.

Firearms come in a variety of designs including the revolving firearm also known as the revolver. A revolver, which can be a pistol or a rifle, includes a cylinder containing plurality of chambers. Each chamber can hold a cartridge. In most modern firearms the cartridge is a metallic cartridge including a case, primer, powder, and projectile or bullet. With "percussive" revolvers, each cylinder holds a charge including a ball or shot and powder which is ignited when the hammer strikes a percussion cap. Examples of "percussive" revolvers include Colt pistols and revolving rifles of which both original models and copies are in use and manufacture.

The cylinder revolves around a central axis to align each chamber, in turn, with the barrel placing the cartridge or charge in an appropriate position for the hammer to strike the primer or percussion cap. The hammer strikes the primer or percussion cap to fire the revolver, igniting the powder and propelling the bullet from the chamber and out through the barrel. The rotation of the cylinder is caused by either the hammer being manually cocked, as in the "single action" or "double action" revolver, or through the use of the trigger in the double action revolver. The cylinder may revolve in either a clockwise or counter-clockwise direction, depending on the design of the firearm.

Firearm safety devices are used to secure a firearm thereby preventing unintended and/or unauthorized firing by a person handling the firearm. However, for a variety of reasons typical known firearm safety devices do not meet the needs of firearm owners.

Firearms safety devices known commonly as "trigger locks" block access to and actuation of the trigger. However these trigger locks do not prevent the rotation of the cylinder in single-action or double-action revolvers. Thus, the cylinder could be rotated by cocking the hammer, which would place a cartridge a position in which it would be aligned with the hammer. In this position, the hammer could be struck, or dropped with sufficient force to break the half-cock or full-cock notch, or to "bounce" the sear from the engagement with either of these notches, thereby firing the weapon.

Trigger locks have used "cable based attachments" to restrict movement or rotation of a cylinder in some revolvers. These arrangements use a "cable" which is inserted through the opening of the frame of the revolver and/or inserted through one of the chambers of the cylinder. In many revolvers the cable cannot be inserted through the individual chambers of the cylinder due to the design of the firearm, requiring that the cylinder be opened in the case of double action revolvers, or removed from the single action revolver in order to make use of the "cable". This allows debris or other forms of material to more easily enter the barrel, chambers, or forcing cone, which increases the likelihood of introducing an unintentional obstruction which can create a hazardous condition for the shooter and those in proximity to the shooter when the firearm is fired. Cables used in this manner can also be difficult and time consuming to remove.

Accordingly, it has been considered desirable to develop a new and improved firearm safety device which would overcome the foregoing difficulties and meet the above-stated needs while providing better and more advantageous results.

SUMMARY OF THE INVENTION

A safety device for securing a revolver is provided.

In accordance with a first aspect of the invention, the safety device includes an assembly for affixing to a revolver and a cylinder block connected to the assembly. The cylinder block includes a rigid leg for extending into a chamber to secure the revolver.

In accordance with a second aspect of the invention the cylinder block includes a base having an aperture. The cylinder block can include a bent portion disposed between the base and the leg.

In accordance with another aspect of the invention, the assembly includes first and second side members for mounting on opposite sides of the trigger guard to affix the assembly to the revolver and one or more pins extending from at least one of the side members for extending through the aperture for attaching the cylinder block to the assembly.

BRIEF DESCRIPTION OF THE DRAWINGS

The invention may take form in certain components and structures, preferred embodiments of which will be illustrated in the accompanying drawings wherein.

DETAILED DESCRIPTION OF THE INVENTION

It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting.

As used herein, the phrase "to secure a revolver" can mean any one or combination of the following: preventing the revolver from firing, preventing the revolver from being loaded, preventing the revolver cylinder from being opened, preventing the revolver cylinder from rotating.

Figure 1:
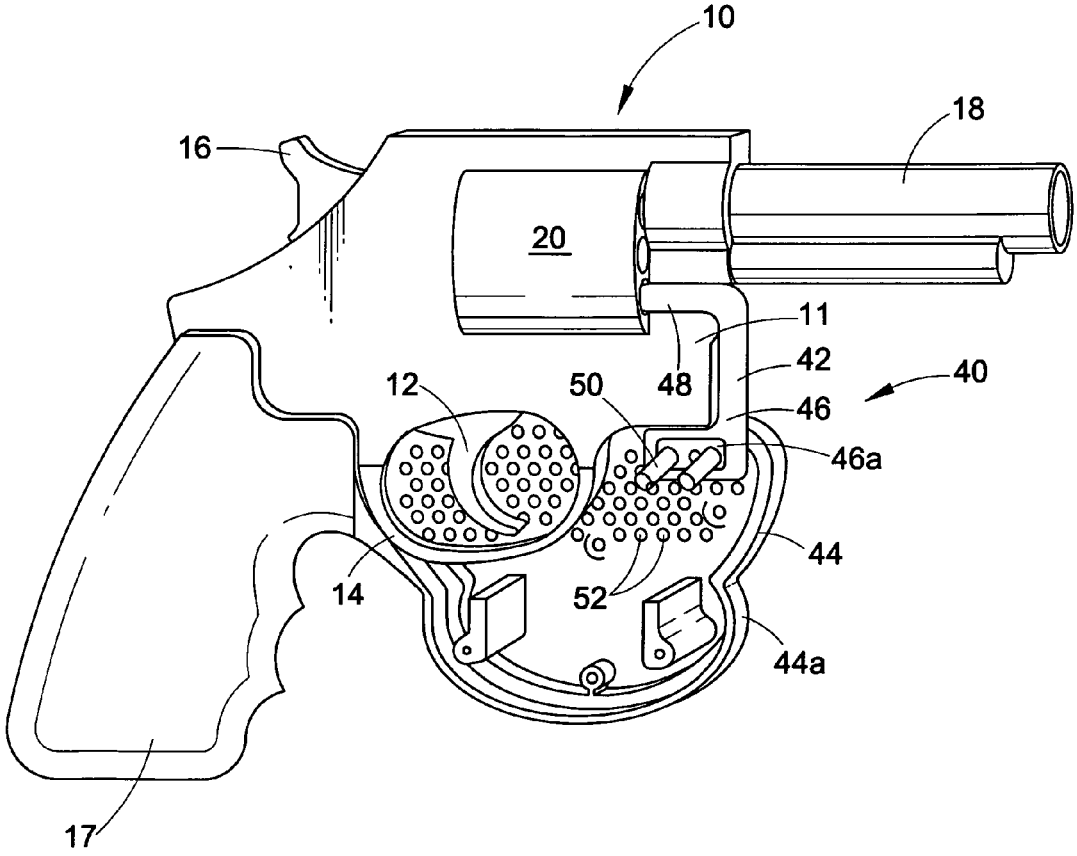
FIG. 1 is a side view of a cylinder block and one side member mounted to a revolver.
Figure 4:
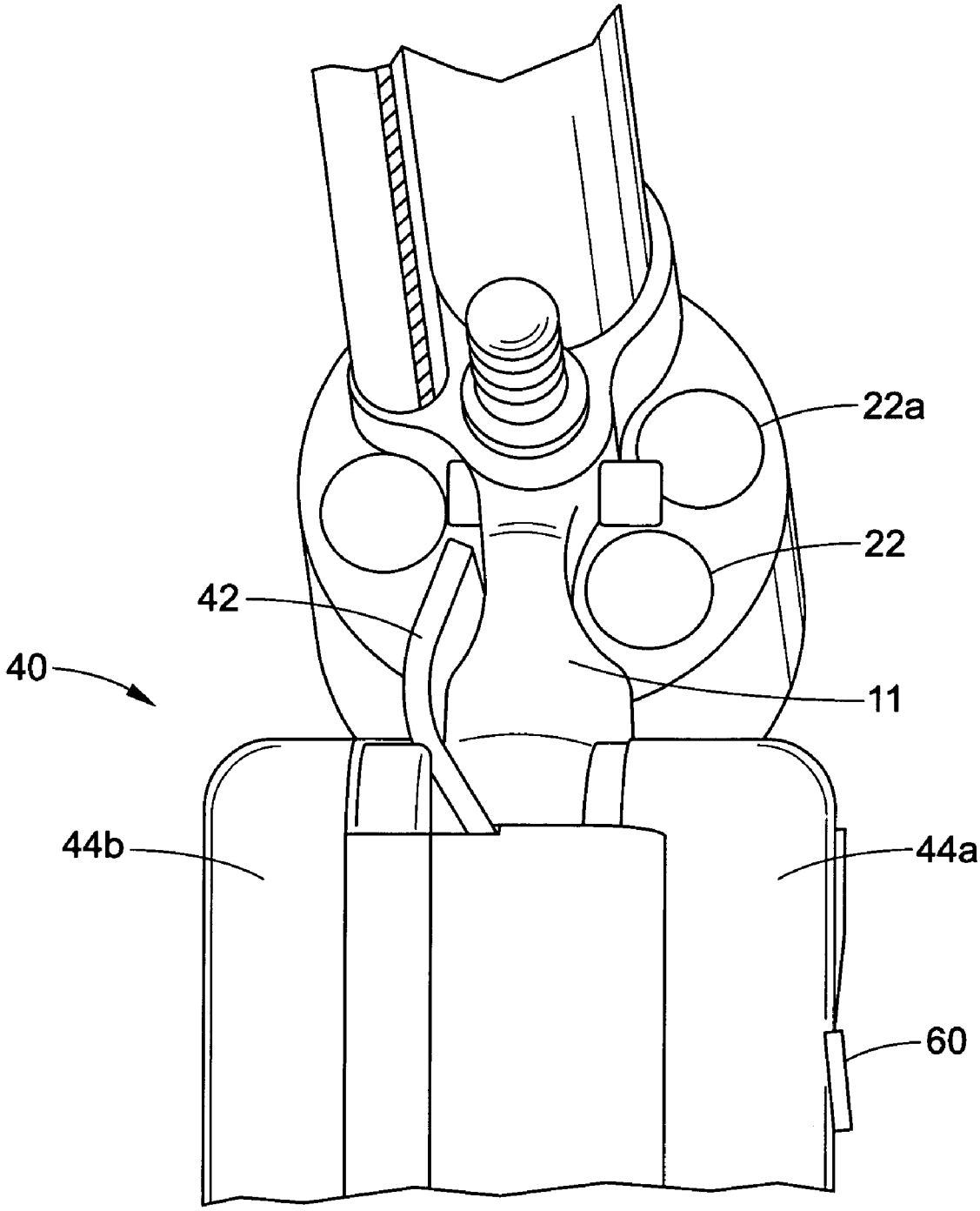
FIG. 4 is a front view of a cylinder block and assembly mounted to a revolver in accordance with the invention.

Referring to FIG. 1, a revolver is shown generally at 10. The revolver 10 includes a frame 11, trigger 12, trigger guard 14, hammer 16, grip 17 and barrel 18. The revolver also includes a cylinder 20 having a plurality of chambers 22 (shown in FIG. 4) each adapted to hold a cartridge or charge (not shown). The chambers 22 each have a receiving end 22*a* disposed nearest the hammer 16, and a front end 22*b* disposed nearest the barrel 18. The revolver 10 can be a single action or double action revolver. The revolver 10 can be a pistol or a rifle.

Figure 2:
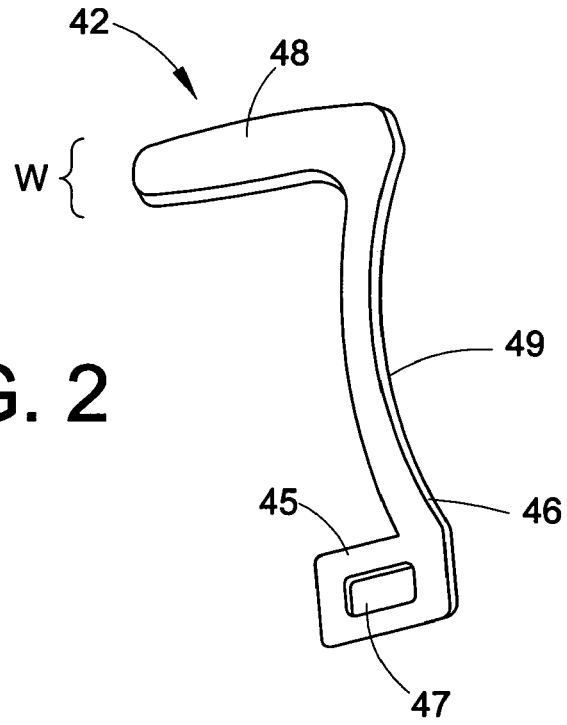
FIG. 2 is a perspective view of a cylinder block in accordance with the invention.
Figure 3:
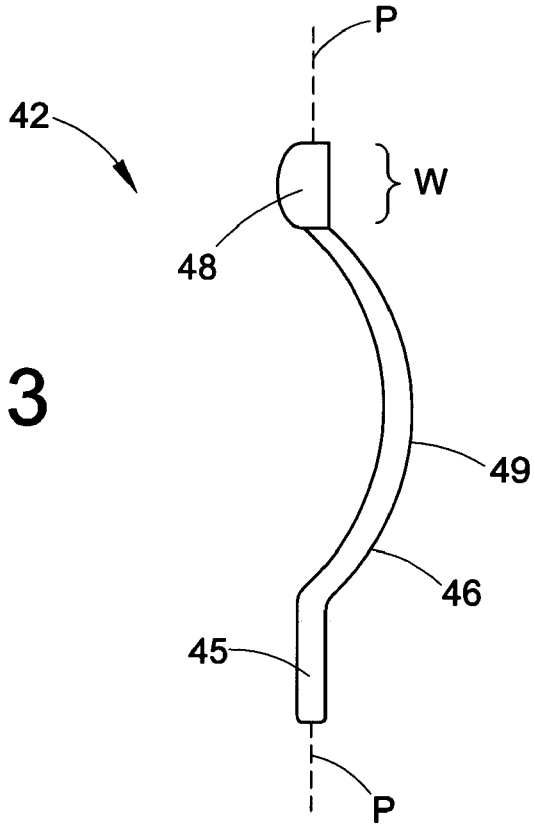
FIG. 3 is a front view of a cylinder block in accordance with the invention.

Referring now to FIGS. 1-3, a safety device for securing the revolver 10 is shown generally at 40. The safety device 40 includes a cylinder block 42. The cylinder block 42 can be attached to an assembly 44, and the assembly can be affixed to the revolver 10 in a manner as shall be described in further detail below. The cylinder block 42 includes a body 46 and a leg 48 extending from the body for extending into a cylinder chamber 22 to secure the revolver 10 as shall be described in further detail below. The cylinder block 42 is preferably rigid, more rigid than a cable or chain, though it can be bent with sufficient force.

The body 46 includes base 45 having an aperture 47 for attaching the cylinder block 42 to an assembly 44 as described below. The body 46 can be straight. The body 46 can also include an optional bent portion 49 disposed between the base 45 and the leg 48. The bent portion 49 can be curved and/or have corners for extending around a portion of the revolver frame 11. In one alternative embodiment which should not be considered limiting, the base 45 and the leg 48 can extend from the bent portion 49 in approximately the same plane, as shown by P in FIG. 2. In this embodiment, the best portion 49 is not co-planer with the base 45 and the leg 48.

The leg 48 has a width W in cross section which is less than the diameter of the chambers 22 in the cylinder 20 thereby allowing the leg to extend into any one of the chambers. The cross sectional width W is preferably small enough to allow the leg 48 to easily slide out of the chamber 20 to facilitate the quick and easy removal of the cylinder block 42 from the revolver 10 as shall be described in further detail below. The leg 48, or at least a portion thereof, can have a rectangular, circular, semicircular, or any other suitably shaped cross sectional shape to provide sufficient strength to prevent distortion or destruction.

The cylinder block 42 is preferably formed of a hard material that resists distortion or destruction such as breaking, bending, sawing, twisting, etc. The cylinder block 42 can be formed of metal, steel, hardened steel, titanium, or any other suitable hard material. The cylinder block 42, formed of metal, can be a hardened in any suitable known manner, including but not limited to alloying, nitriding, nitrocarburizing, and rolling to further resist any form of attempted destruction such as sawing, cutting, snipping, etc. The cylinder block 42 can be formed of stamped metal. The cylinder block 42, or portions thereof such as for example, the base 45, can be formed of wire. The cylinder block 42 can include a padded coating such as a plastic, polymer, etc. which is soft enough to prevent scratching the revolver 10 and/or damaging the cylinder 20.

The assembly 44 can be a trigger lock having a pair of side members 44*a* and 44*b* mounted to opposite sides of the trigger guard 14 in any suitable known manner, such as for example that disclosed in co-pending U.S. application Ser. No. 09/927,063 filed Aug. 9, 2001 which is hereby incorporated by reference herein. The assembly 44 can include a lock 60 for locking the side members together while mounted to the trigger guard to prevent the removal of the assembly 44 from the revolver by unauthorized persons.

The cylinder block 42 can be attached to the assembly 44 to prevent the cylinder block from being removed from the chamber when the assembly 44 is affixed to the revolver 10. In one example, which should not be considered limiting, the aperture 47 formed in the base 45 receives a fastener 50 connected to the assembly for attaching the cylinder block 42 to the assembly 44. The fastener 50 can be one or more pins 50 having headless ends 50*a* extending from one or both of the side members 44*a*, 44*b* or any other fastener which allows the cylinder block 42 to slide off it. One or both of the side members 44*a*, 44*b* can include a plurality of pin receiving holes 52 disposed at several locations on the side members, thereby providing flexibility in locating the cylinder block 42 relative to the side members. Both side members 44*a*, 44*b* can have pin receiving holes 52 disposed in mutually opposite locations so that the pins 50 extend from the pin receiving hole in one side member through the aperture 47 in the base 45 to the pin receiving hole in the other side member when the assembly is affixed to the revolver 10. Attaching the cylinder block 42 to the assembly using one or more pins 50 extending from one or both of the side members 44*a*, 44*b* through the body aperture 47 allows the cylinder block 42 to be easily separated from the side members by simply sliding off the pins when the assembly 44 is removed from the revolver 10.

Figure 5:
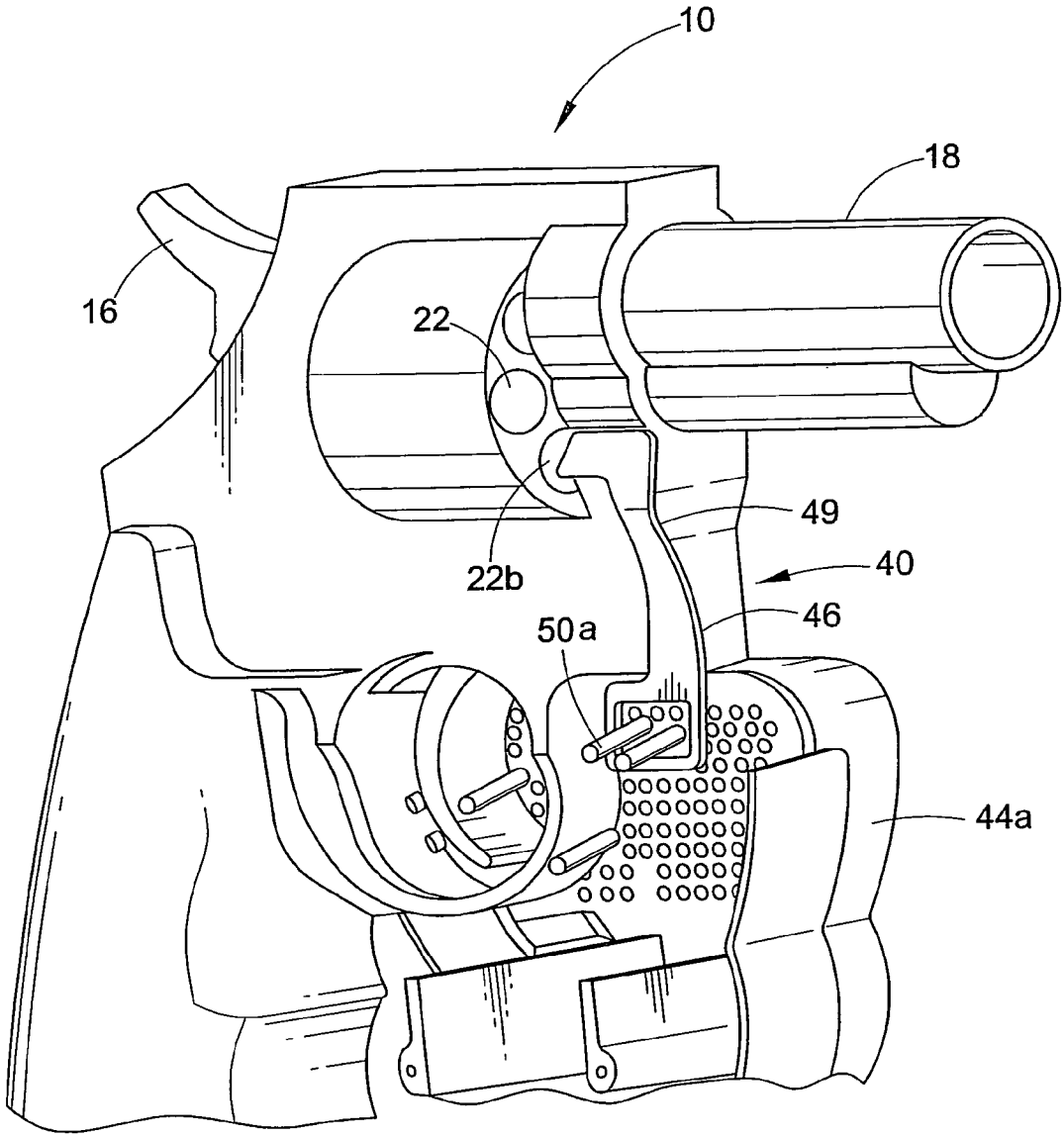
FIG. 5 is a perspective view of a cylinder block and one side member mounted to a revolver.
Figure 6:
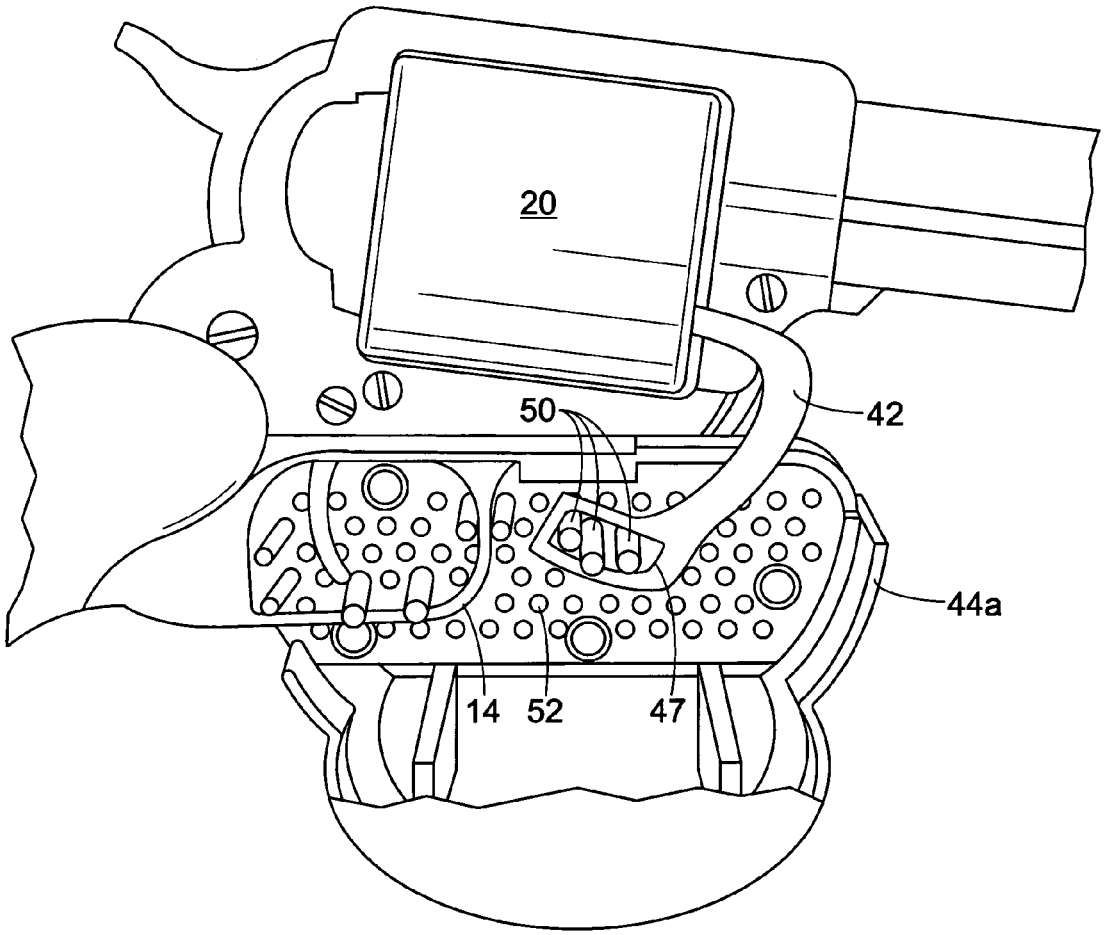
FIG. 6 is a side view of a cylinder block and one side member mounted to a revolver.

The installation of the cylinder block 42 on the revolver 10 shall now be described. Installing the cylinder block 42 includes inserting the cylinder block leg 48 into a chamber 22 of the revolver 10, attaching the cylinder block 42 to the assembly 44, and affixing the assembly to the revolver over the trigger guard 14. The cylinder block leg 48 is inserted into an unloaded, empty chamber 22, preferably from the front end 22*b*, of the cylinder 20 without extending into the barrel, that is to say remaining external to the barrel as shown in FIGS. 5 and 6. The cylinder 20 is preferably closed within the revolver frame 11, although it can be open. The chamber 22 receiving the cylinder block 42 can be any chamber in which the cylinder block leg 48 can be inserted so as to provide a tight fit with the revolver 10 and the assembly 44 when the assembly is affixed to the revolver. The cylinder block body 46 is oriented with respect to a first side member 44*a* so that the cylinder block body aperture 47 is placed over an available pattern of pin receiving holes 50. Pins 50 are then inserted through the aperture 47 and into the available pin receiving holes 52 in one of the side members 44*a* or 44*b*. Alternatively, the cylinder block leg 48 is inserted into an empty chamber 22 with the pins 50 already inserted into the pin receiving holes 52. The cylinder block 42 can then be rotated about the leg 48 within the chamber bringing the base 45 over the pins 5O so that the pins are received through the aperture 47.

The second side member 44*b* is then brought together with to the first side member 44*a* so that the side members are mounted on opposite sides of the trigger guard 14 and affixed to the revolver 10 such that the cylinder block extends from between the affixed together side members. The pins 50 can be received in pin receiving holes formed in the second side member 44*b* as described above. The side members 44*a*, 44*b* can be squeezed together to prevent movement of the cylinder block 42 with respect to the assembly 44 thereby securing the revolver. The side members 44*a*, 44*b* can be locked together with the lock 52 in any suitable known manner to prevent unauthorized persons from removing the safety device 40 from the revolver 10. The chambers 22, other than the chamber receiving the cylinder block leg 48, can remain loaded with the cylinder block 42 installed on the revolver 10, but are preferably unloaded when the revolver is secured.

The safety device 40, including the cylinder block 42, can be quickly and easily removed by unlocking the assembly 44 and pulling the side members 44*a*, 44*b* apart separating them from the revolver 10. When the side members 44*a*, 44*b* are separated, the cylinder block 42 is allowed to simply slide off the fastener, such as the pins 50, and slide out of the chamber 22 falling away from the revolver 10 enabling the revolver to be fired quickly by a person authorized to remove the safety device 40.

The installed cylinder block 42 secures the revolver 10 as defined above, including but not limited to preventing the revolver from being fired and/or preventing the cylinder 20 from rotating enough to enable the revolver to be fired. The cylinder block 42 can also prevent a double action revolver cylinder 20 from being opened and/or from being loaded.

Figure 7:
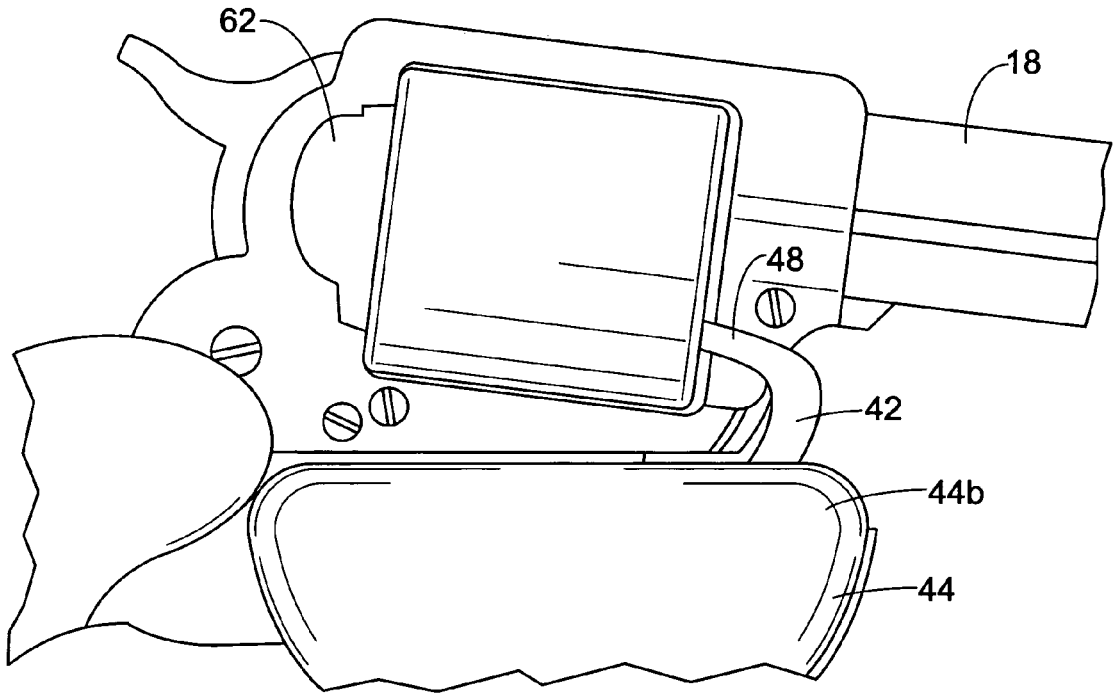
FIG. 7 is a side view of a cylinder block and assembly to a revolver.

Single action revolvers 10 designed for metallic cartridges include a loading gate, shown at 62 in FIG. 7. The loading gate 62 is typically a metal, spring-loaded latch, located in most single action designs on the top, right hand side of the rear of the frame 11. The loading gate 62 is designed to retain the unfired cartridges and fired cartridge cases in the cylinder 20 as the cylinder rotates. The loading gate 62 also keeps foreign debris from entering the cylinder 20 or from striking the primer of the cartridge. Each of the chambers 22 is able to hold one cartridge of the appropriate caliber for the particular firearm.

Single action revolvers 10 can be loaded by swinging the loading gate 62 open to expose the rear of the chamber 22*b* which is aligned therewith. A cartridge is inserted into the exposed chamber 22, and the cylinder 20 is then manually rotated to expose the next chamber so that the next cartridge can be loaded therein. This action can be repeated until all of the cylinder chambers 22 have been filled. In some makes and models of single action revolvers it may be possible to load one chamber when the loading gate open is open with the cylinder block 42 installed. However, the installed cylinder block 42 prevents the cylinder 20 from being rotated enough that the chamber having the cartridge is moved to a position in which the loaded cartridge is placed under the hammer 16 or firing pin, which prevents the single action revolver from being fired.

In "double-action" revolvers 10 the cylinder is able to be opened—or "swung out" of the frame of the revolver, for loading. The installed cylinder block 42 prevents the cylinder 20 from being opened, and thus the revolver 10 from being loaded. The installed cylinder block 42 also prevents the double action revolver cylinder 20 from rotating or revolving thereby preventing the revolver from firing.

This invention allows the cylinder block 42 to be inserted into any revolver of any type with the cylinder 20 closed within the frame 11 of the revolver 10. The cylinder block 42 increases the safety of all revolvers 10 upon which it may be used by preventing the placement of a cartridge, or "charge", under the firing pin in such a way as to allow the firing pin to actuate the firing of the firearm. The cylinder block 42 also reduces hazards by allowing the revolver 10 to be secured in a "closed" condition as was intended by the designer/manufacturer. This reduces or prevents debris or other foreign material/objects from entering the revolver and causing a dangerous or potentially deadly effect when the firearm is fired. This also reduces or prevents debris or foreign material from entering the revolver and in some way disabling the mechanical function of the firearm thereby endangering the user if the firearm is needed for self defense.

The invention has been described with reference to preferred embodiments. Obviously, modifications and alterations will occur to others upon reading and understanding the preceding specification. It is intended that the invention be construed as including all such modifications and alterations insofar as they come within the scope of the appended claims or the equivalents thereof.

What is claimed is:

1. A safety device for a revolver comprising:

a revolver having a revolving cylinder, a trigger, and a barrel, said cylinder having at least one chamber with a front opening;

a trigger lock assembly including a pair of side members and a lock for releasably affixing the side members together on opposite sides of the revolver for blocking access to the trigger of the revolver, at least one of the side members including a pin receiving hole;

a cylinder block having a leg extending into the front opening of the chamber of the revolver and remaining external to the barrel of the revolver for securing the revolver, said cylinder block including a body with a base that has an aperture and that extends between the side members, and said cylinder block being rigid formed of at least one of metal, steel, hardened steel, hardened metal, titanium, stamped metal and wire; and a fastener attaching the cylinder block to the assembly, the fastener being a pin extending through the aperture into the pin receiving hole, the pin having a headless end for allowing the cylinder block to slide off the pin when the side assemblies are released from each other and the revolver;

said leg of said cylinder block is of a predetermined length and said barrel of said revolver is of a predetermined length, and wherein said predetermined length of said leg is less then said predetermined length of said barrel.

2. The safety device defined in claim 1 wherein both of the side members include at least one pin receiving hole and the pin extends from the at least one pin receiving hole of one of the side members through the aperture and into the at least one pin receiving hole of the other one of the side members.

3. The safety device defined in claim 2 wherein the pin is releasably received in at least one of the at least one pin receiving holes in at least one of the side members enabling the side members to be separated from each other to expose the headless end.

4. The safety device defined in claim 1 wherein the body includes a bent portion disposed between the base and the leg, said bent portion extending around a portion of a frame of the revolver.

5. The safety device defined in claim 4 wherein the base and the leg extend from the bent portion along a plane and the bent portion is not co-planar with the base and the leg.

6. The safety device defined in claim 1 wherein the cylinder block includes a padded coating.

7. The safety device defined in claim 1 wherein the leg has at least one of a semicircular cross sectional shape, a circular cross sectional shape, and a rectangular cross sectional shape.

8. A safety device for a revolver comprising:

a revolver having a revolving cylinder, a trigger, a trigger guard, and a barrel, said cylinder having at least one chamber with a front opening;

a trigger lock assembly including a pair of side members and a lock for releasably affixing the side members together on opposite sides of the trigger guard of the revolver blocking access to the trigger of the revolver, at least one of the side members including a pin receiving hole;

a rigid cylinder block having a body defining an aperture and a leg extending from the body external to the barrel of the revolver into the front opening of the chamber of the revolver closed with a frame of the revolver for securing the revolver, said body being disposed between the side members and extending into the chamber of the cylinder, and said cylinder block being formed of at least one of metal, steel, hardened steel, hardened metal, titanium, stamped metal and wire; and a fastener releasably attaching the body to the assembly between the side members, the fastener being a pin extending through the aperture into the pin receiving hole;

said leg of said cylinder block is of a predetermined length and said barrel of said revolver is of a predetermined length, and wherein said predetermined length of said leg is less then said predetermined length of said barrel.

* * * * *